US009079757B2

(12) United States Patent
Bjork

(10) Patent No.: US 9,079,757 B2
(45) Date of Patent: Jul. 14, 2015

(54) CAP HANDLING TOOL AND METHOD OF USE

(75) Inventor: Jason W. Bjork, Newport, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/235,467

(22) PCT Filed: Aug. 2, 2012

(86) PCT No.: PCT/US2012/049239
§ 371 (c)(1),
(2), (4) Date: Jan. 28, 2014

(87) PCT Pub. No.: WO2013/019911
PCT Pub. Date: Feb. 7, 2013

(65) Prior Publication Data

US 2014/0190131 A1 Jul. 10, 2014

Related U.S. Application Data

(60) Provisional application No. 61/514,298, filed on Aug. 2, 2011.

(51) Int. Cl.

| | |
|---|---|
| ***B67B 7/02*** | (2006.01) |
| ***B01L 99/00*** | (2010.01) |
| ***B67B 7/00*** | (2006.01) |
| *B01L 3/00* | (2006.01) |

(52) U.S. Cl.
CPC . *B67B 7/02* (2013.01); *B01L 99/00* (2013.01); *B67B 7/00* (2013.01); *B01L 3/50853* (2013.01); *B01L 3/50855* (2013.01); *B01L 2200/0689* (2013.01)

(58) Field of Classification Search
CPC ..... B67B 7/16; B67B 7/10; B67B 7/02; B01L 99/00; B01L 3/50853; G01N 2035/0405
USPC ..... 53/492, 489; 81/3.09, 3.4, 3.55, 3.57
See application file for complete search history.

(56) References Cited

U.S. PATENT DOCUMENTS 1,707,398 A 4/1929 Hyland
3,787,946 A * 1/1974 Schimek ..... 29/270

(Continued)

FOREIGN PATENT DOCUMENTS

WO 96/09554 3/1996
WO 00/21667 4/2000

*Primary Examiner* — Andrew M Tecco

(57) ABSTRACT

A tool (100) is provided for use in uncapping a plurality of linearly-oriented, spaced-apart tubes; the tubes capped with a unitary closure device comprising a plurality of spaced-apart, linearly-oriented alternating caps and openings, each cap having a cap upper surface and being connected to at least one adjacent cap by at least two connecting structures, each of the at least two connecting structures having a connecting structure upper surface and a connecting structure lower surface, the at least two connecting structures and two adjacent caps forming a boundary of an opening. The tool comprises a body (30) having first portion (42) for engagement by a user and a second portion comprising a base (52) and a plurality of spaced-apart projections (60) extending there-from. Each projection is configured for releasably engaging one of the openings in the unitary closure device. Optionally, the first portion is configured in a non-coplanar relationship with respect to the second portion. Methods of use are also provided.

4 Claims, 6 Drawing Sheets

(56) References Cited

U.S. PATENT DOCUMENTS

| | | | | | |
|---|---|---|---|---|---|
| 4,479,406 | A | | 10/1984 | Shoemaker, III | |
| 4,683,782 | A | * | 8/1987 | Warburg | 81/3.57 |
| 4,858,502 | A | * | 8/1989 | Warburg | 81/3.57 |
| 5,253,551 | A | | 10/1993 | DeVaughn | |
| 5,628,962 | A | | 5/1997 | Kanbara et al. | |
| 5,950,504 | A | | 9/1999 | Italia | |
| 5,967,001 | A | * | 10/1999 | Regester | 81/3.55 |
| 6,001,310 | A | * | 12/1999 | Shaffer et al. | 422/548 |
| 6,109,139 | A | * | 8/2000 | Regester et al. | 81/3.47 |
| 6,170,359 | B1 | | 1/2001 | Asa | |
| 6,309,603 | B1 | | 10/2001 | Locke | |
| 2011/0289889 | A1 | | 12/2011 | Kohanski et al. | |

* cited by examiner

CAP HANDLING TOOL AND METHOD OF USE

CROSS REFERENCE TO RELATED APPLICATION

This application is a national stage filing under 35 U.S.C. 371 of PCT/US2012/049239, filed Aug. 2, 2012, which claims the benefit of U.S. Provisional Patent Application No. 61/514,298, filed Aug. 2, 2011, which is incorporated herein by reference in its entirety.

BACKGROUND

High-throughput biochemical assays often use of unitary strips of 8 reaction tubes, which ordinarily are loaded into wells in a tube rack for processing. In some apparatus, four such tube racks are processed simultaneously. In use, the operator loads a strip of capped tubes into the tube rack and removes the strip of caps manually by pulling on the tab to lift the caps progressively from the tubes at one end to the other. The tubes are then loaded with the appropriate reagents, usually with a micropipette, and recapped by hand. The procedure of uncapping and recapping is repeated after the process (e.g., DNA amplification) to remove the samples for analysis.

If the tubes are empty, the act of removing the strip of caps in rapid succession obviously does not present any problem of ejecting contents from the tubes. However, when it becomes necessary to uncap the tubes that are full or partially full (as in the case of tubes purchased pre-packaged with reagents), it is often the case that some of the contents will be released. Furthermore, recapping the tubes also might result in spillage of some of the contents from the tubes. To minimize spillage, the technician will typically need to carefully remove and/or replace one cap at a time, which is not only tedious and time consuming, but also requires repetitive movements. Moreover, practice has shown that the closely packed tubes in the tube rack are difficult to recap manually. A careless or hurried technician may not always get all of the tubes properly recapped, which may result in test failures due to evaporation or contamination. Removing strips of caps by hand also can result in stretching of the strip, making recapping subject to failure. There exists a need for an improved method to decap and recap tubes.

SUMMARY

The present disclosure generally relates to a tool, and methods of use thereof, for removing a unitary closure device, comprising a plurality of caps, from two or more containers. Optionally, the tool can be used to restore the caps on the containers. In particular, the present disclosure relates to a tool for removing a plurality of caps from two or more tubes (e.g., microcentrifuge tubes that are used for performing chemical or biochemical reactions such as polymerase chain reaction ("PCR"), for example) and, optionally, restoring the caps onto the tubes. In some embodiments, the tool is adapted so that the plurality of caps can be temporarily retained on the tool while the tool is placed against a surface (e.g., a laboratory bench top), thereby permitting the operator to use both hands to perform other tasks (e.g., dispense or remove reagents). Advantageously, the tool is configured so that, while the tool is resting against the surface, the plurality of caps is held on the tool in a position whereby no portion of the cap can contact the surface, thereby preventing contamination of the cap with materials (e.g., chemicals, nucleic acids, microorganisms) that may be present on the surface.

In one aspect, the present disclosure provides a tool for use in uncapping a plurality of linearly-oriented, spaced-apart tubes; the tubes capped with a unitary closure device comprising a plurality of spaced-apart, linearly-oriented alternating caps and openings, each cap having a cap upper surface and being connected to at least one adjacent cap by at least two connecting structures, each of the at least two connecting structures having a connecting structure upper surface and a connecting structure lower surface, the at least two connecting structures and two adjacent caps forming a boundary of an opening. The tool can comprise a body having first portion for engagement by a user and a second portion comprising a base and a plurality of spaced-apart projections extending therefrom. Each projection can comprise a longitude and a terminus. Each projection can be configured for releasably engaging one of the openings in the unitary closure device. The plurality of projections is configured to align with two or more of the plurality of openings in the unitary closure device.

In any of the above embodiments, each of the plurality of projections can be dimensioned to fit closely within and extend through the opening. In some embodiments, each of the plurality of projections can extend further from the base than the distance from a plane defined by the cap upper surfaces of two adjacent caps to the connecting structure lower surface of at least one of the connecting structures there between. In any of the above embodiments, the first portion further can comprise an edge. In any embodiment, the edge further can comprise a groove. In any of the above embodiments, the edge further can comprise a curvate edge. In any of the above embodiments, the body can be made of a material selected from the group consisting of metal, a plastic polymer, wood, and composites thereof. In any of the above embodiments, the at least one projection further can comprise at least two concave surfaces.

In any of the above embodiments, the at least one projection further can comprise a surface comprising a cap-engaging element configured to engage a first connecting structure wherein, when the tool is operably engaged with the unitary closure device, the cap-engaging element is oriented toward the first connecting structure. In some embodiments, the projection further can comprise a second cap-engaging element opposite the first cap-engaging element, wherein the second cap-engaging element is configured to engage a second connecting structure.

In any of the above embodiments, the first portion can be configured in a non-coplanar relationship with respect to the second portion, wherein the first portion has a first side and a second side, wherein the second portion comprises the base and the at least one projection, the at least one projection comprising a terminus; wherein, when the second side of the first portion is held against a surface, the distance between the terminus of the at least one projection and the surface is sufficient to hold any portion of a cap fully-engaged on the projection off the surface.

In another aspect, the present disclosure provides a method of uncapping a plurality of tubes. The method can comprise providing a plurality of tubes aligned along a longitudinal axis and capped with a unitary closure device comprising a plurality of spaced-apart, linearly-oriented alternating caps and openings, each cap having a cap upper surface and being connected to at least one adjacent cap by at least two connecting structures, each of the at least two connecting structures having a connecting structure upper surface and a connecting structure lower surface, the at least two connecting structures and two adjacent caps forming a boundary of an opening; and a tool according to any of the above embodiments. The method further can comprise inserting at least one projection into at least one of the openings and rotating the tool substantially about the longitudinal axis in a first direction. In any of the above embodiments, the method further can comprise using the tool to recap the tubes. In any of the above embodiments of the method, using the tool to recap the tubes can comprise rotating the tool substantially about the longitudinal axis in a direction opposite the first direction. In any of the above embodiments, the method further can comprise using the groove to secure the caps.

The invention may provide a number of advantages. For example, the tool can be used to uncap or recap a plurality of tubes consisting of two tubes, three tubes, four tubes, six tubes, or eight tubes, for example. Additionally, the tool can be used temporarily to hold a unitary closure device while the operator performs other tasks (e.g., dispensing a reagent into one or more tubes and/or removing an aliquot from one or more of the plurality of tubes. In some embodiments, the tool can hold the caps off a surface, so that they are not contaminated by substances present on the surface.

Additional details of these and other embodiments are set forth in the accompanying drawings and the description below. Other features, objects and advantages will become apparent from the description and drawings, and from the claims.

DETAILED DESCRIPTION

The present disclosure is directed to a tool that is configured to releasably engage a unitary closure device comprising a plurality of spaced-apart, linearly-oriented alternating caps and openings and subsequently, using a single motion, remove a plurality of the caps from two or more of the tubes. Advantageously, the closure device can be held engaged with the tool for a period of time and, subsequently, the tool can be used to restore the caps on the tubes.

Figure 1A:
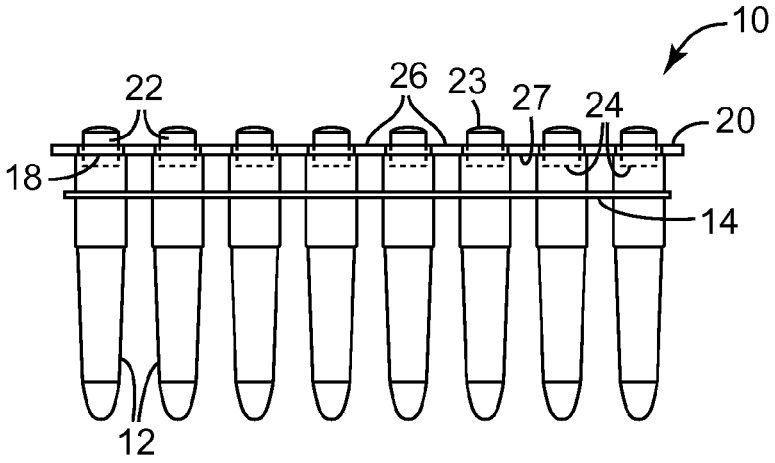
FIG. 1A is a side view of one embodiment of a capped tube assembly.

FIG. 1A shows a side view of one embodiment capped-tube assembly 10. The assembly 10 comprises a unitary multi-tube device 12 comprising a plurality of spaced-apart tubes 14, the multi-tube device 12 capped with a unitary closure device 20. Each tube 14 in the multi-tube device 12 is connected to at least one adjacent tube via a crosspiece 16. Such tubes 14 and unitary closure devices 20 can be used for PCR analyses, for example, and both are commercially-available (e.g., from USA Scientific, Ocala, Fla.). The unitary closure device 20 comprises a plurality of spaced-apart caps 22. Each cap 22 is has a cap top edge 23 and a bottom edge 24 and is connected to at least one adjacent cap 22 via a connecting structure 25. Typically, each cap 22 further is dimensioned such that the bottom edge 24 of the cap 22 fits closely within an opening 18 of one of the tubes 14, thereby sealing the tube 14. Each connecting structure 25 has an upper surface 26 and a lower surface 27

Figure 1B:
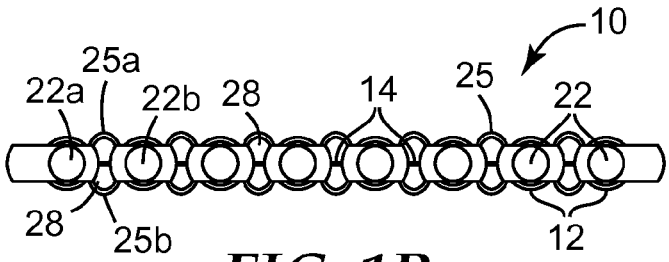
FIG. 1B is a top view of the capped tube assembly of FIG. 1.

FIG. 1B shows a top view of the assembly 10 of FIG. 1A. The assembly 10 includes a plurality of linearly-oriented, spaced-apart tubes 14. Each tube 14 is connected to at least one adjacent tube via a crosspiece 16. The assembly 10 further comprises a unitary closure device 20. The closure device 20 comprises a plurality of linearly-oriented caps 22 that are dimensioned to fit an opening (not shown) in each tube 14 and are spaced apart to correspond to the distance between the individual tubes 14 of the multi-tube device 12. Typically, the spacing of the caps 22 in the closure device 20 also corresponds to the spacing of individual tubes (not shown) in a typical tube rack (not shown) and, thus, the closure device 20 can also be used with individual tubes.

Referring back to FIG. 1B, each cap 22 is connected to at least one other cap via two connecting structures 25. Two adjacent caps (e.g., 22*a* and 22*b*), along with the corresponding connecting structures (e.g., 25*a* and 25*b*) that connect the adjacent caps, form the boundary of an opening 28 between the adjacent caps. Tools of the present disclosure are configured for use in removing at least two adjacent caps 22 of the unitary closure device 20 from at least two adjacent tubes (e.g., either two or more individual tubes or two or more tubes 14 that are joined together in a multi-tube device 12 as described above).

Figure 2A:
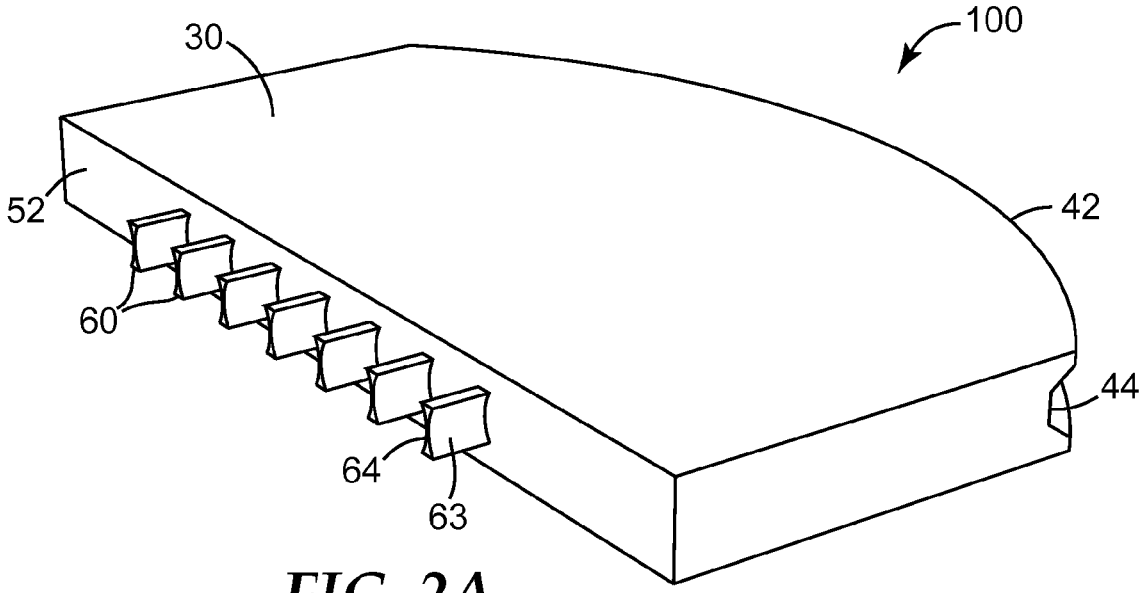
FIG. 2A is a perspective view of one embodiment of a tool for decapping and capping tubes according to the present disclosure.
Figure 2B:
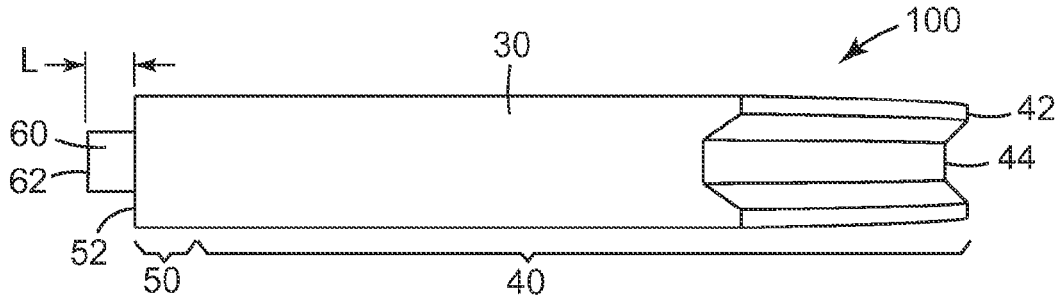
FIG. 2B is a side view of the tool of FIG. 2A.
Figure 2C:
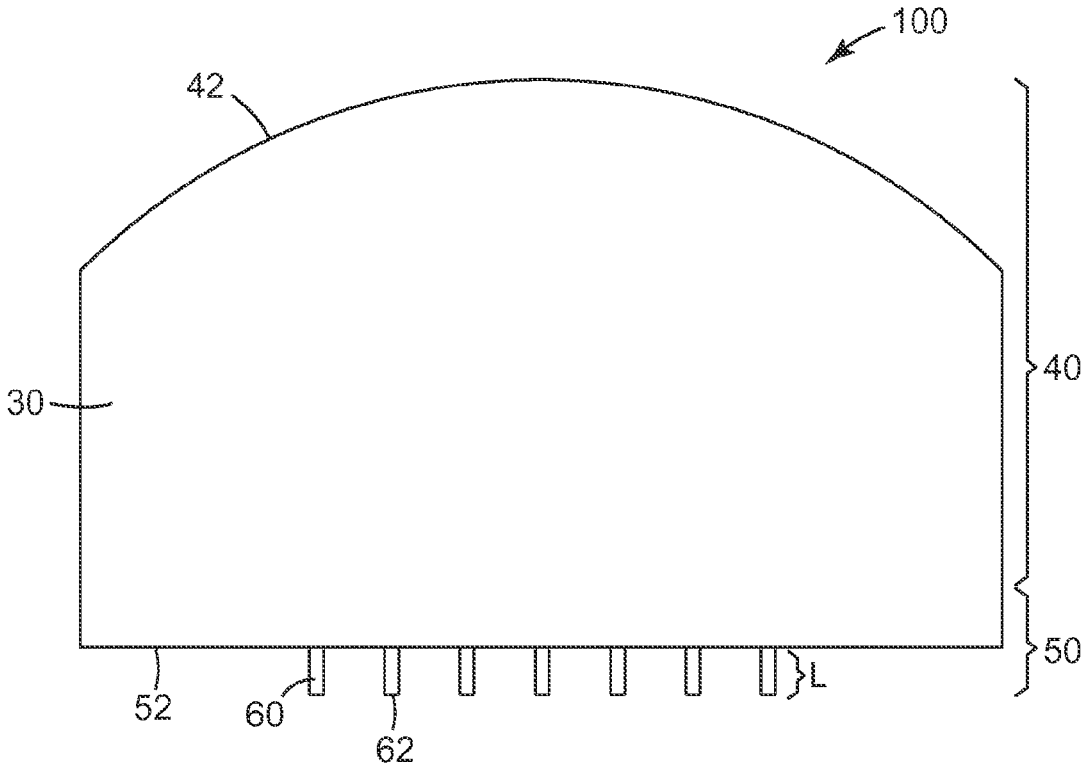
FIG. 2C is a plan view of the tool of FIG. 2A.

FIGS. 2A-C show one embodiment of a tool 100 for decapping and capping tubes according to the present disclosure. The tool 100 comprises a body 30 having a first portion 40 and a second portion 50. The body 30 preferably is rigid or semi-rigid and can be constructed from a variety of materials including, for example, metal, plastic, or wood, a ceramic, a composite material, or combinations thereof.

The first portion 40 of the tool 100 is configured for engagement by a user. That is, the first portion 40 is intended to be grasped by a person or a machine. In any embodiment, the first portion may comprise an edge 42. Optionally, the edge 42 may comprise a curvate edge 42, for comfort and ease of grasping by a human operator. In any embodiment, the edge 42 further may comprise a groove 44. The groove 44 can be shaped and dimensioned to releasably engage the caps of a capped tube assembly such as, for example, the assembly 10 shown in FIG. 1A. The groove 44 can be used to securely fasten a cap to one or more tubes, as described below.

The second portion 50 of the tool 100 comprises a base 52 and a plurality of spaced-apart projections 60 extending therefrom. The spacing of the projections 60 is configured to coincide with the spacing of the openings (for example, see FIG. 1B) in the unitary closure device with which the tool 100 will be used. Each projection 60 comprises a terminus 62 and a longitude "L" that extends from the base to the terminus. The projections 60 are preferably constructed from a rigid material (e.g., metal, wood, plastic) and may be constructed from the same material as the body 30. In some embodiments, the body 30 and projections 60 may be formed as a unitary part, for example by injection-molding a thermoplastic polymer or by using a machining process to form the projections in a unitary piece of metal or polymeric material.

The cross-sectional area of the terminus 62 should fit within the cross-sectional area of the opening 28 (see FIG. 1B); unless the material from which the unitary closure device is constructed is sufficiently flexible to accommodate a projection 60 that has at least one dimension (e.g., width) that is slightly larger than the opening. Preferably, the projections 60 are dimensioned to be slightly smaller than the opening, thereby facilitating the insertion and removal of the tool from the openings and also to facilitate contact between the projection 60 and the unitary closure device (not shown) when using the tool 100 to remove the closure device from one or more tubes (not shown).

Projections 60 may be formed in various shapes. For example, the projections 60 may be substantially cuboid, parallelepiped, ellipsoidal, or cylindrical. In the illustrated embodiment of FIG. 2A-B, each projection 60 is substantially parallelepiped, with two major surfaces (63 and 64, respectively) being concave in order to closely conform to the biconcave shape of the opening 28 shown in FIG. 1B.

FIG. 2C shows a plan view of the tool 100 of FIG. 2A. In addition to showing the body 30 with a first portion 40 and second portion 50, the edge 42, and the base 52 with the projections 60 extending therefrom; FIG. 2C shows that each projection 60 of the plurality of projections approximately the same size and has a length "L" measured from the base 52 to the terminus 62 of the projection 60.

Figure 3:
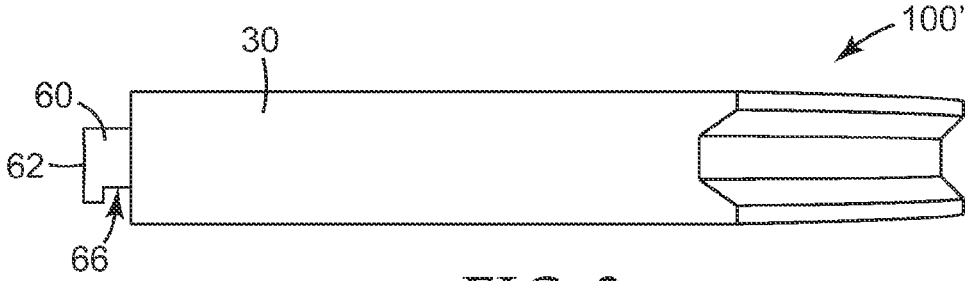
FIG. 3 is a side view of an alternative embodiment of a tool for decapping and capping tubes according to the present disclosure.

FIG. 3 shows a side view of another embodiment of a tool 100' according to the present disclosure. The tool 100' comprises a body 30 with a first portion 40 a second portion 50, a base 52, an edge 42, and optional groove 44, as described above. The tool 100' further comprises a plurality of projections 60, at least one projection comprising a cap engaging element 66. The cap-engaging element 66 is a structural feature (e.g., a recess, indentation, notch, or the like) in one of the longitudinal portions (e.g., either or both of edges 64) of the projection that is configured to face a connecting structure between two caps of a unitary closure device (see FIG. 1A-B). The cap-engaging element 66 is configured to releasably engage a connecting structure of a unitary closure device. Advantageously, the cap-engaging element 66 can prevent a connecting structure of a unitary closure device from slipping off the projection 60 when operating the tool 100'. Additionally, the cap-engaging element 66 can keep the unitary closure device engaged with the 100' (i.e., prevent the closure device from falling off the tool) if the tool 100' is held in a position where the projections 60 are sloped downward.

Figure 4A:
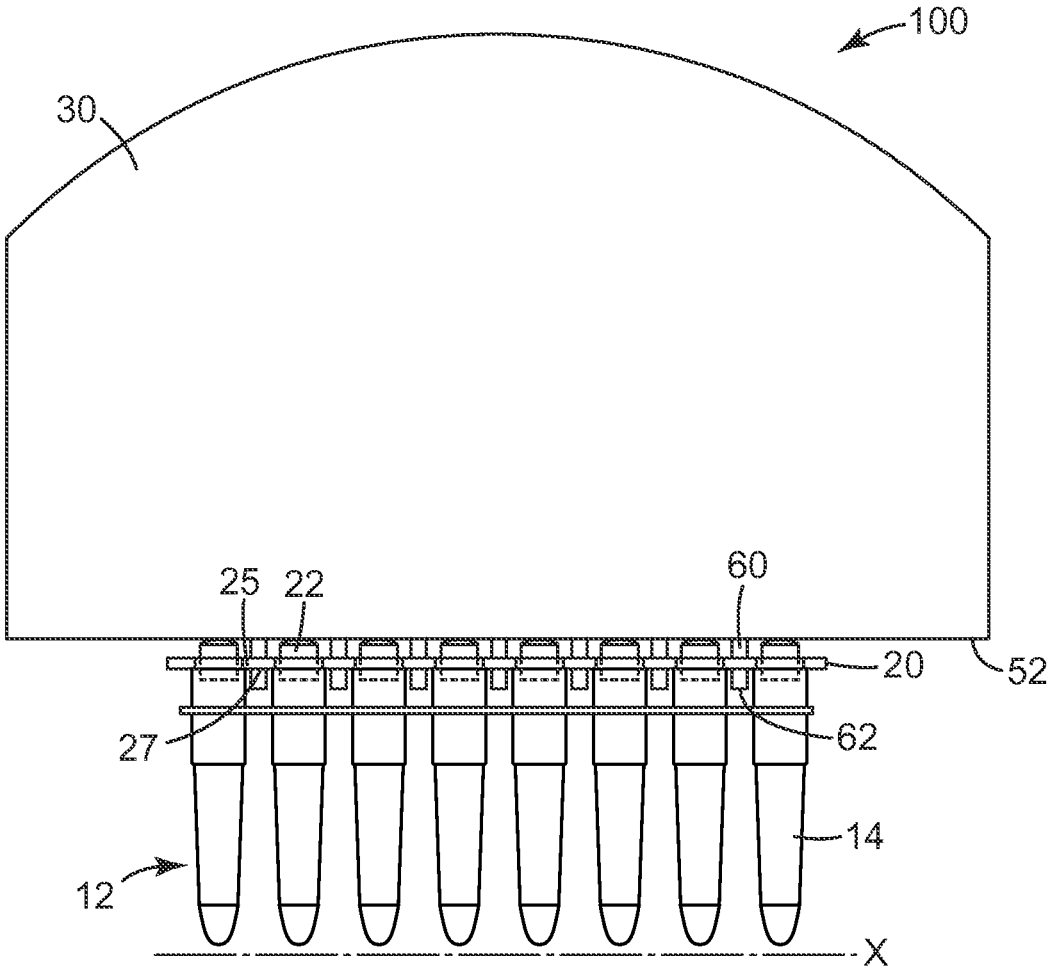
FIG. 4A shows a plan view of the tool of FIG. 2A engaged in a first operable position with the capped tube assembly of FIG. 1A.
Figure 4B:
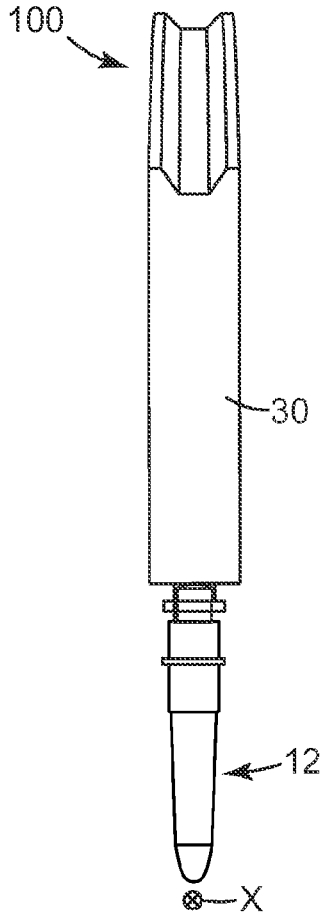
FIG. 4B shows a side view of the tool of FIG. 4A engaged in the first operable position with the capped tube assembly.

Tools of the present disclosure can be used to remove, in as few as two steps, the caps from plurality of tubes. One step in the decapping process includes engaging the caps with the tool. FIGS. 4A-B the tool 100 of FIGS. 2A-C engaged in a first operational position with the unitary closure device 20 of capped tube assembly 10 of FIG. 1A. The plurality of tubes 14 in the capped tube assembly 10 are substantially aligned along a longitudinal axis "X". The tool 100 and assembly 10 can be placed in the first operational position, for example, by having an operator (not shown) grasp the body 30 of the tool 100, manually align one or more of the projections 60 of the tool 100 with one or more openings (see opening 18 of FIG. 1B), and manually insert the one or more projections into the one or more openings. In the first operational position, at least one of the plurality of projections 60 is inserted through at least one of the openings (see opening 28 of FIG. 1B). Preferably, the at least one projection 60 is inserted through the openings until a portion of the base 52 of the tool 100 contacts the top edge 23 of at least one cap 22. More preferably, the at least one projection 60 is inserted through the openings until a portion of the base 52 contacts the two or more caps 22 adjacent the projection 60. When placing the tool 100 in the first operational position, the at least one projection 60 should be inserted far enough through the opening for the terminus 62 of the projection 60 to extend beyond the lower surface 27 of at least one of the connecting structures 25 that forms the opening.

Figure 4C:
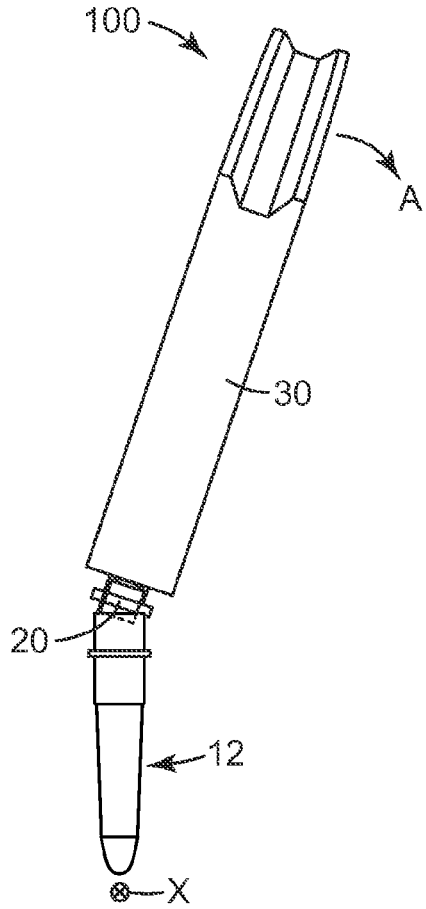
FIG. 4C shows a side view of the tool of FIG. 2A engaged in a second operable position with the capped tube assembly of FIG. 1A.

After the tool 100 is placed into the first operational position shown in FIGS. 4A-B, a plurality of caps 22 can be removed (e.g., simultaneously removed) from two or more tubes 14 by rotating (e.g., manually rotating) the tool 100 about the longitudinal axis "X", as shown by arrow "A" in FIG. 4C, for example. As the tool is rotated about the axis "X", the bottom edge 24 of one or more caps 22 is pried from one or more tubes 14 and, upon sufficient rotation of the tool 100, the plurality of caps 22 separate from the tubes 14. Conveniently, the tool 100 can be rotated either clockwise or counterclockwise about the axis "X" to remove the caps 22. It is contemplated that, even though a capped tube assembly 10 may comprise more than two tubes 14 (e.g., the assembly may comprise eight or twelve or more tubes 14), the tool 100 may be used to decap two tubes 14 or more than two tubes.

Figure 5:
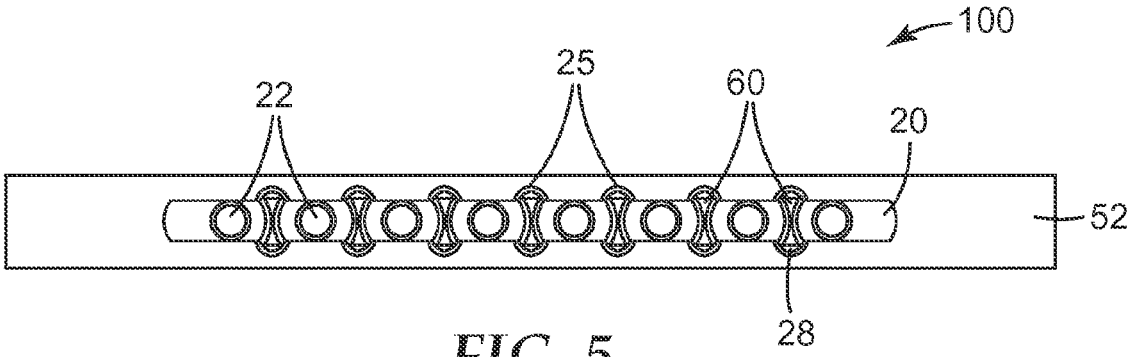
FIG. 5 shows a plurality of projections of the tool of FIG. 2A engaged with a plurality of openings of a unitary closure device.

After the unitary closure device 20 is separated from a plurality of tubes 14, the device 20 may, if the tool 100 is held at a sufficient angle (e.g., the plane of the body 30 is held at an angle where the projections are substantially perpendicular to the force of gravity or the projections are angled upward, away from the force of gravity), the unitary closure device 20 with a plurality of caps 22 can remain releasably engaged with the tool 100, as shown in FIG. 5. Also illustrated in FIG. 5 are the relative locations of the base 52, the Openings 28 in the closure device 20, the connecting structures 25, and the projections 20.

Figure 6:
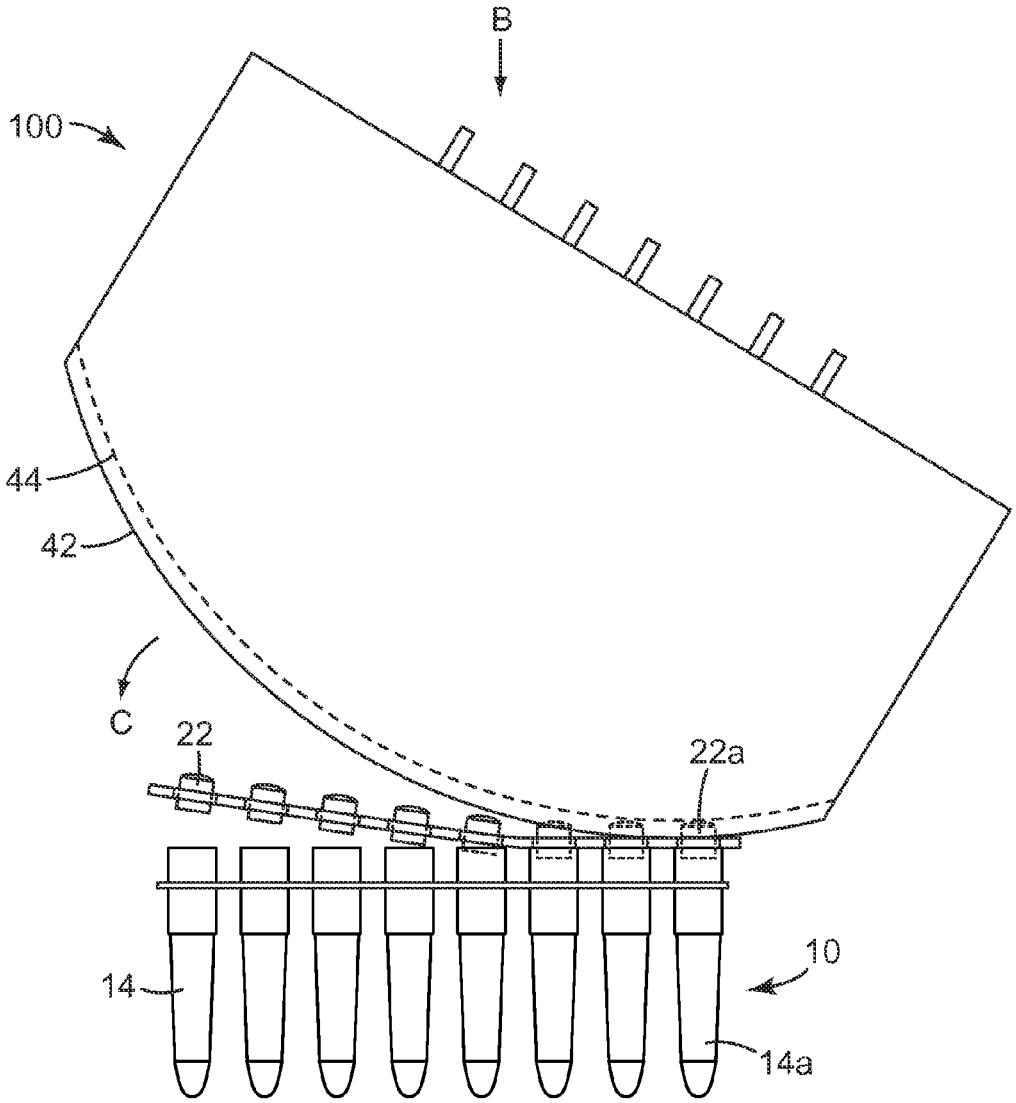
FIG. 6 shows the use of the groove in the tool of FIG. 2A to firmly seat a plurality of caps in a plurality of linearly-arranged tubes according to the present disclosure.

Tools of the present disclosure may optionally comprise a groove (e.g., groove 44, as shown in FIGS. 2A-B). The groove can be used to firmly seat a plurality of caps in a plurality of linearly-arranged tubes. The tubes may be linearly arranged in a tube rack, for example. The caps may be individual caps or may be caps that are part of a unitary closure device as described herein. FIG. 6 shows a side view of a tool 100 having a groove 44 that is operationally engaged with at least one cap 22*a* of a tube 14*a* of a capped tube assembly 10. A first cap (e.g., cap 22*a*) can be manually positioned over the opening (not shown) of a first tube (e.g., tube 14*a*) In this position, pressure (e.g., manual pressure) can be applied to the tool 100 in the direction of arrow "A", whereby, the pressure is transferred to the cap 22 causing the cap to be securely seated in the tube 14 to seal it against liquid loss and/or contamination. Advantageously, when the tool 100 comprises a curvate edge 42, the edge 42 of the tool 100 can be moved in a "rolling" motion, as shown by arrow "B" in FIG. 3B, to securely seat a plurality of caps 22 in a plurality of tubes 14 in a capped tube assembly 10.

Figure 7:
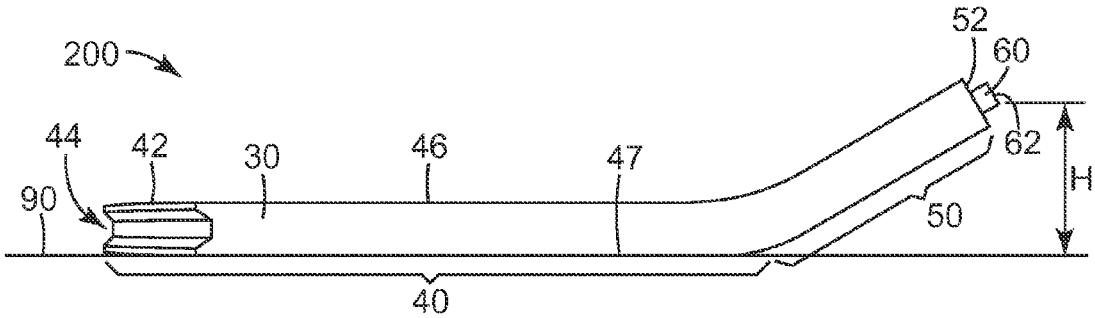
FIG. 7 is one embodiment of a tool with non-coplanar portions for decapping and capping tubes according to the present disclosure.

In any of the above embodiments of a tool for decapping and capping tubes, the first portion of the body can be configured in a non-coplanar relationship with respect to the second portion. FIG. 7 shows a side view of a tool 200 for decapping and capping tubes, wherein the tool 200 comprises a first portion 40 of the body 30 in non-coplanar relationship with a second portion 50. The first portion 40 of the tool 200 is configured for engagement by a user, as described above. The first portion comprises a first side 46 and a second side 47. The second side 47 can be configured to be placed against a surface 90 such that, when the second side 47 of the first portion 40 is held against the surface 90, the distance "H" between the terminus 62 of the at least one projection 60 and the surface 90 is sufficient to hold any portion of a cap fully-engaged on the projection 60 off the surface 90. Preferably, the distance "H" is sufficient to hold any portion of the fully-engaged cap (not shown) at least 2 mm off the surface. In some embodiments, the distance "H" is sufficient to hold any portion of the fully-engaged cap (not shown) at least 5 mm off the surface. In some embodiments, the distance "H" is sufficient to hold any portion of the fully-engaged cap (not shown) at least 10 mm off the surface. In some embodiments, the distance "H" is sufficient to hold any portion of the fully-engaged cap (not shown) more than 10 mm off the surface. In any embodiment, the first portion may comprise an edge 42. Optionally, the edge 42 may comprise a curvate edge 42 and/or an optional groove 44, as described above. The second portion 50 of the tool 200 comprises a base 52 with a plurality of spaced-apart projections 60 extending therefrom, both as described above.

Figure 8A:
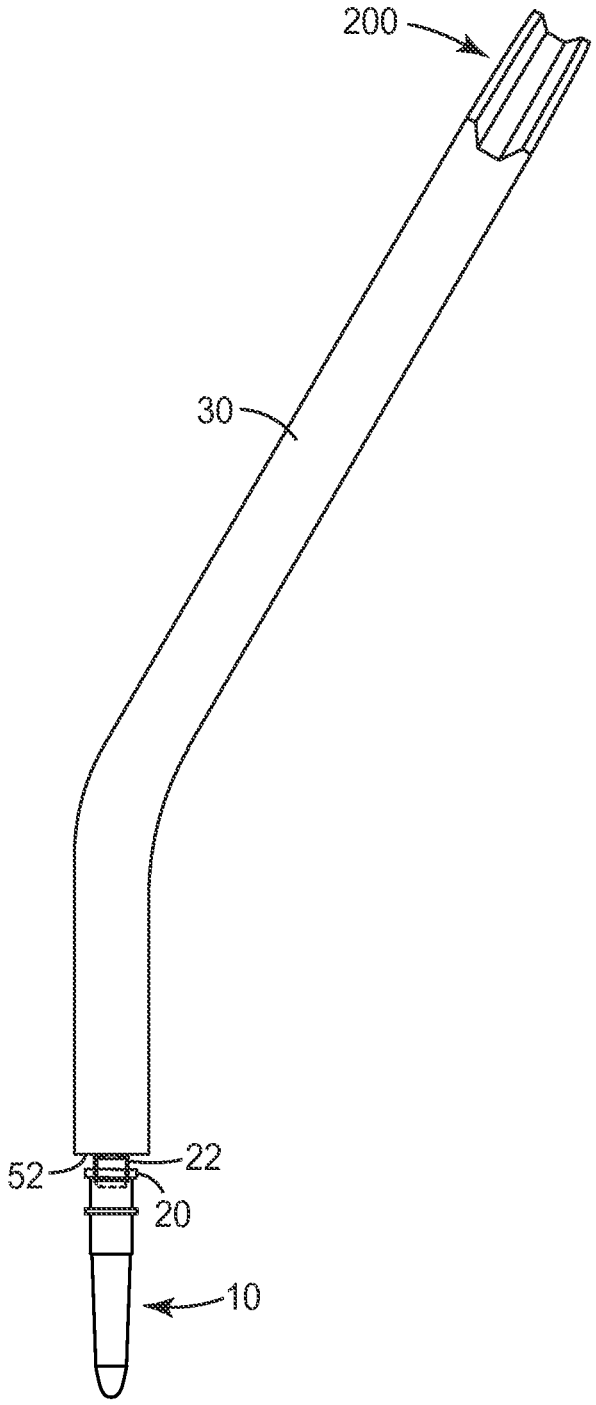
FIG. 8A shows a plan view of the tool of FIG. 2A engaged in a first operable position with the capped tube assembly of FIG. 1A.
Figure 8B:
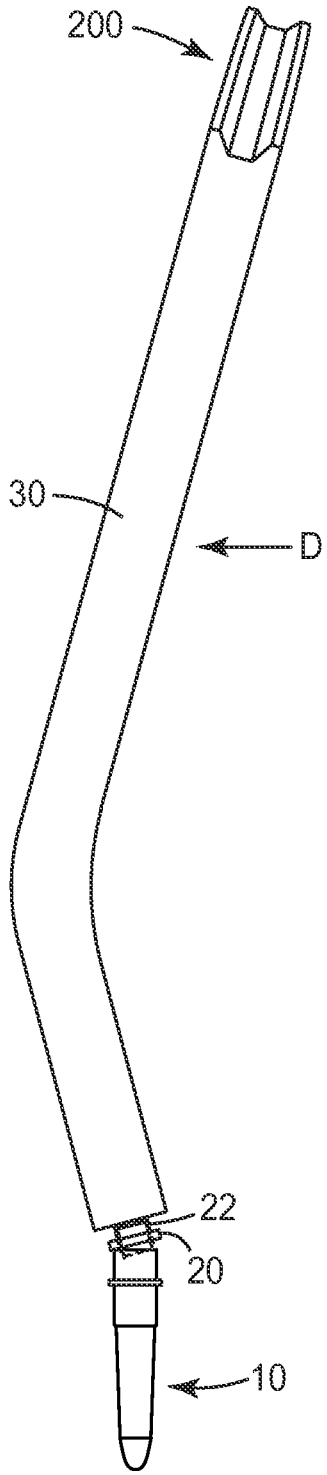
FIG. 8B shows a side view of the tool of FIG. 2A engaged in a second operable position with the capped tube assembly of FIG. 1A.

The tool 200 of FIG. 7 can be used to remove, in as few as two steps, the caps from plurality of tubes. One step in the decapping process includes engaging the caps with the tool, as shown and described for tool 100 in FIGS. 4A-B. FIG. 8A shows tool 200 engaged in a first operational position with the unitary closure device 20 of the capped tube assembly 10 shown and described in FIG. 1A. The tool 200 and assembly 10 can be placed in the first operational position, for example, by having an operator (not shown) grasp the body 30 of the tool 200, manually align one or more of the projections 60 of the tool 200 with one or more openings (see opening 18 of FIG. 1B), and manually insert the one or more projections into the one or more openings. In the first operational position, at least one of the plurality of projections 60 is inserted through at least one of the openings (see opening 28 of FIG. 1B). Preferably, the at least one projection 60 is inserted through the openings until a portion of the base 52 of the tool 200 contacts the top edge of at least one cap 22. More preferably, the at least one projection 60 is inserted through the openings until a portion of the base 52 contacts the two or more caps 22 adjacent the projection 60.

After the tool 200 is placed into the first operational position shown in FIG. 8A, a plurality of caps 22 can be removed (e.g., simultaneously removed) from two or more tubes by rotating (e.g., manually rotating) the tool 200 (e.g., in the direction shown by arrow "D") as described for tool 100 above and shown in FIG. 4C. As the tool is rotated one or more caps 22 are pried from the capped tube assembly 10 and, upon sufficient rotation of the tool 200, the plurality of caps 22 separate from the assembly 10. Conveniently, the tool 200 can be rotated either clockwise or counterclockwise. It is contemplated that, even though a capped tube assembly 10 may comprise more than two tubes (e.g., the assembly may comprise eight or twelve or more tubes), the tool 200 may be used to decap two tubes or more than two tubes.

Upon further movement of the tool 200 in direction "D" (not shown), the tool 200 will be disposed in a position (e.g., the position shown in FIG. 7) where the unitary closure 20 will be retained, by frictional and/or gravitational force, engaged with the projections 60 of the tool 200. The tool 200 can temporarily be placed on a surface (e.g., a level surface such as a laboratory bench top, as depicted in FIG. 7) with the unitary closure device engaged with the projections of the tool (not shown). While the tool is resting against the surface, the plurality of caps is held on the tool in a position whereby no portion of the cap can contact the surface, thereby preventing contamination of the cap with materials (e.g., chemicals, nucleic acids, microorganisms) that may be present on the surface. This permits the operator to use both hands to perform other tasks (e.g. the transfer of reagents or samples to or from one or more of the tubes. Subsequently, the unitary closure device 20 can be restored on the plurality of tubes simply by reversing the motions that were used to remove the unitary closure device 20.

Embodiments

Embodiment 1 is a tool for use in uncapping a plurality of linearly-oriented, spaced-apart tubes; the tubes capped with a unitary closure device comprising a plurality of spaced-apart, linearly-oriented alternating caps and openings, each cap having a cap upper surface and being connected to at least one adjacent cap by at least two connecting structures, each of the at least two connecting structures having a connecting structure upper surface and a connecting structure lower surface, the at least two connecting structures and two adjacent caps forming a boundary of an opening; the tool comprising:

a body having first portion for engagement by a user and a second portion comprising a base and a plurality of spaced-apart projections extending therefrom;

wherein each projection comprises a longitude and a terminus;

wherein each projection is configured for releasably engaging one of the openings in the unitary closure device;

wherein the plurality of projections is configured to align with two or more of the plurality of openings in the unitary closure device.

Embodiment 2 is the tool of embodiment 1, wherein each of the plurality of projections is dimensioned to fit closely within and extend through the opening.

Embodiment 3 is the tool of embodiment 2, wherein each of the plurality of projections extends further from the base than the distance from a plane defined by the cap upper surfaces of two adjacent caps to the connecting structure lower surface of at least one of the connecting structures there between.

Embodiment 4 is the tool of any one of the preceding embodiments, wherein the first portion further comprises an edge.

Embodiment 5 is the tool of embodiment 4, wherein the edge further comprises a groove.

Embodiment 6 is the tool of embodiment 4 or embodiment 5, wherein the edge comprises a curvate edge.

Embodiment 7 is the tool of any one of the preceding embodiments, wherein the body is made of a material selected from the group consisting of metal, a plastic polymer, wood, and composites thereof.

Embodiment 8 is the tool of any one of the preceding embodiments, wherein the at least one projection further comprises at least two concave surfaces.

Embodiment 9 is the tool of any one of the preceding embodiments, wherein the at least one projection further comprises a surface comprising a cap-engaging element configured to engage a first connecting structure wherein, when the tool is operably engaged with the unitary closure device, the cap-engaging element is oriented toward the first connecting structures.

Embodiment 10 is the tool of embodiment 9, wherein the projection further comprises a second cap-engaging element opposite the first cap-engaging element, wherein the second cap-engaging element is configured to engage a second connecting structure.

Embodiment 11 is the tool of any one of the preceding embodiments;

wherein the first portion is configured in a non-coplanar relationship with respect to the second portion;

wherein the first portion has a first side and a second side;

wherein the second portion comprises the base and the at least one projection, the at least one projection comprising a terminus;

wherein, when the second side of the first portion is held against a surface, the distance between the terminus of the at least one projection and the surface is sufficient to hold any portion of a cap fully-engaged on the projection off the surface.

Embodiment 12 is the tool of embodiment 11, wherein the distance between the terminus of the projection and the surface is sufficient to hold any portion of the fully-engaged cap at least 2 mm off the surface.

Embodiment 13 is the tool of embodiment 12, wherein the distance between the terminus of the projection and the surface is sufficient to hold any portion of the fully-engaged cap at least 10 mm off the surface.

Embodiment 14 is a method of uncapping a plurality of tubes, comprising:

providing a plurality of tubes aligned along a longitudinal axis and capped with a unitary closure device comprising a plurality of spaced-apart, linearly-oriented alternating caps and openings, each cap having a cap upper surface and being connected to at least one adjacent cap by at least two connecting structures, each of the at least two connecting structures having a connecting structure upper surface and a connecting structure lower surface, the at least two connecting structures and two adjacent caps forming a boundary of an opening; and a tool according to any of embodiments 1 through 13;

inserting at least one projection into at least one of the openings; and rotating the tool substantially about the longitudinal axis in a first direction.

Embodiment 15 is the method of embodiment 14, further comprising the step of using the tool to recap the tubes.

Embodiment 16 is the method of embodiment 15, wherein using the tool to recap the tubes comprises rotating the tool substantially about the longitudinal axis in a direction opposite the first direction.

Embodiment 17 is the method of embodiment 15 or embodiment 16, further comprising the step of using the groove to secure the caps.

A number of embodiments of a tool adapted for decapping and capping tubes have been described. For example, in some embodiments, the tool comprises first and second portions that are in non-coplanar relationship to one another.

Nevertheless, various modifications may be made without departing from the spirit and scope of the invention. For example, one or more features described herein may be used with or without other described features. Moreover, several features described herein may be used in a tool to open containers other than tubes. These and other embodiments are within the scope of the following claims.

The invention claimed is:

1. A method of uncapping a plurality of tubes, comprising:

providing a plurality of tubes aligned along a longitudinal axis and capped with a unitary closure device comprising a plurality of spaced-apart, linearly-oriented alternating caps and openings, each cap having a cap upper surface and being connected to at least one adjacent cap by at least two connecting structures, each of the at least two connecting structures having a connecting structure upper surface and a connecting structure lower surface, the at least two connecting structures and two adjacent caps forming a boundary of an opening; and a tool comprising:

a body having a first portion for engagement by a user and a second portion comprising a base and a plurality of spaced-apart projections extending therefrom;

wherein each of the spaced-apart projections comprises a longitude and a terminus;

wherein each projection is configured for releasably engaging one of the openings in the unitary closure device;

wherein the plurality of projections is configured to align with two or more of the plurality of openings in the unitary closure device;

wherein the body has a first side and a second side;

wherein the second side of the second portion is angled-with respect to the second side of the first portion;

wherein, when the second side of the first portion is held against a surface, the distance between the terminus of each projection of the plurality of projections and the surface is sufficient to hold any portion of a cap fully-engaged on the projection off the surface;

inserting at least one projection of the plurality of projections into at least one of the openings; and rotating the tool substantially about the longitudinal axis in a first direction.

2. The method of claim 1, further comprising the step of using the tool to recap the tubes.

3. The method of claim 2, wherein using the tool to recap the tubes comprises rotating the tool substantially about the longitudinal axis in a direction opposite the first direction.

4. The method of claim 2, further comprising the step of using the groove to secure the caps.

* * * * *